US005593029A

United States Patent [19]

Both

[11] Patent Number: 5,593,029

[45] Date of Patent: Jan. 14, 1997

[54] SHIRT PACKED IN A CAN-LIKE ARRANGEMENT FOR PRESENTATION

[76] Inventor: Walter Both, Süderweg 9, 24997 Wanderup, Germany

[21] Appl. No.: 645,948

[22] Filed: May 14, 1996

[51] Int. Cl.[6] ..... B65D 85/18

[52] U.S. Cl. ..... 206/278; 206/495

[58] Field of Search ..... 206/278, 281, 206/282, 495; 2/115, 243.1

[56] References Cited

U.S. PATENT DOCUMENTS

| | | | |
|---|---|---|---|
| 483,198 | 9/1892 | Acheson | 206/278 |
| 3,421,839 | 6/1969 | Ward | 206/525 |
| 4,928,831 | 5/1990 | Kirsch | 206/281 |
| 5,221,004 | 6/1993 | Murphy | 206/495 |

*Primary Examiner*—Paul T. Sewell
*Assistant Examiner*—Nhan Lam

[57] ABSTRACT

A shirt is provided in a can-like presentation arrangement. The arrangement includes a tube-shaped stabilizing element having an outer side and two open ends. Two lid-shaped end elements are fixed on these open ends and fixing devices are provided for fixing areas of the shirt around the lid-shaped end elements. A middle area of the shirt is rolled onto the outer side of the tube-shaped stabilizing element. Additional areas of the shirt extend beyond the open ends of the tube-shaped stabilizing element and are arranged to be stuffed within the open ends of the tube-shaped stabilizing element before the lid-shaped end elements are fixed on the tube-shaped stabilizing element.

7 Claims, 1 Drawing Sheet

SHIRT PACKED IN A CAN-LIKE ARRANGEMENT FOR PRESENTATION

BACKGROUND OF THE INVENTION

1. Field of the Invention

The present invention relates to a shirt packed in a can-like presentation arrangement.

Usually, shirts are packed by folding them twice along their longitudinal axis, which runs from the shoulder to the bottom end of the shirt. The shirt is then folded across the longitudinal axis into a more or less rectangular packet. The upper surface of this rectangular packet displays the collar and the front side of the shirt below the collar.

SUMMARY OF THE INVENTION

The object of the present invention is to provide another way of packing a shirt, which is especially useful for arranging shirts in an orderly manner one behind the other on shelves, as tin cans are packed. In this way one shirt can be easily removed from a quantity of shirts packed in this manner, without disturbing other shirts. It is also possible to stack the shirts in a pyramid, in which small end surfaces show the color of the shirts.

This arrangement requires a sturdy arrangement for presentation, so that the shirts can be stacked, and calls for shirts shaped as identical to each other as possible.

In a preferred embodiment, colored designs may be applied to the shirt in a packed state. When the shirt is unfolded, the colored designs will show in special places, for instance in the chest area of the shirt.

According to the invention these objects are achieved by a shirt packed in a can-like arrangement for presentation, that employs a tube-shaped stabilizing element having an outer side and two open ends. Two lid-shaped end elements are fixed on the open ends of the tube-shaped stabilizing element. Fixing devices fix areas of the shirt around the lid-shaped end elements. A middle area of the shirt is rolled onto the outer side of the tube-shaped stabilizing element. Additional areas of the shirt extend beyond the open ends of the tube-shaped stabilizing element and are positioned within the tube-shaped stabilizing element.

The present invention includes the following additional advantageous features.

The additional areas of the shirt that extend beyond the open ends of the tube-shaped stabilizing element are arranged to be stuffed within the open ends of the tube-shaped stabilizing element before the lid-shaped end elements are fixed on the tube-shaped stabilizing element.

The lid-shaped end elements comprise stuffing elements clamped in a clamping fashion within the open ends of the tube-shaped stabilizing element. At least one of the lid-shaped end elements has a frusto-conical shape.

The shirt is arranged folded approximately in half in its longitudinal dimension along a horizontal median edge arranged on the outer side of the tube-shaped stabilizing element, with the shirt enclosing the tube-shaped stabilizing element. The areas of the shirt fixed around the lid-shaped end elements are the sleeves of the shirt.

One form of packing provides the exact same form of presentation for different shirts, in that the dimensions are established by the tube-like stabilizing element and the two lid-shaped end elements that provide lateral closure.

It is advantageous to have an arrangement in which the lid-shaped end elements are fitted into the stabilizing element with some clamping force. Since the large area of the middle of the shirt is packed without folds, the shirt can be worn immediately when it is opened without ironing.

By providing shrink-wrap around the shirt and the stabilizing element, the shirt will not become dirty and the outer surface of the packing is smooth. Alternatively, or in addition to a shrink-wrap, a wrap-around label (banderol) allows information to be printed on the packaging, for example pricing labels, and provides a further means to fix the shirt about the tube-like stabilizing element.

By folding the shirt along its horizontal median and rolling the shirt on the tube-like stabilizing element starting from the collar, the front area of the shirt becomes the outer surface of the shirt in its rolled state. An advertising logo may then be printed on the shirt in its rolled state. Once folded in this manner, the front area of the shirt is the outer surface of the shirt packing.

BRIEF DESCRIPTION OF THE DRAWINGS

Preferred embodiments of the invention will now be described, taken together with the drawings, in which.

DETAILED DESCRIPTION OF PREFERRED EMBODIMENTS

Figure 3:
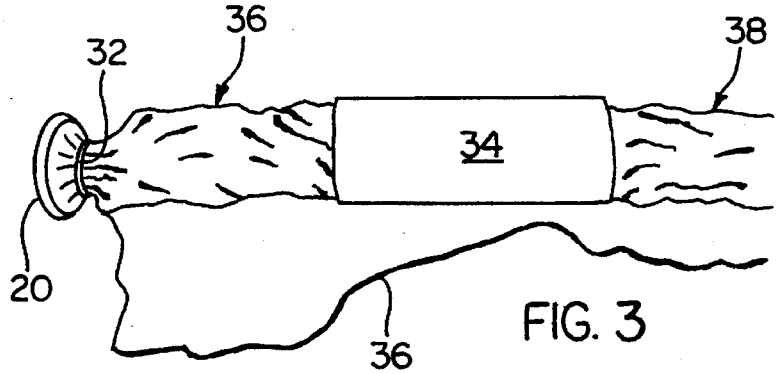
FIG. 3 shows a side view of the shirt with areas of the sleeves folded over the lid-shaped end elements and fixed by the fastening elements about the lid-shaped end elements, a middle area of the shirt being rolled around the tube-shaped stabilizing elements.
Figure 4:
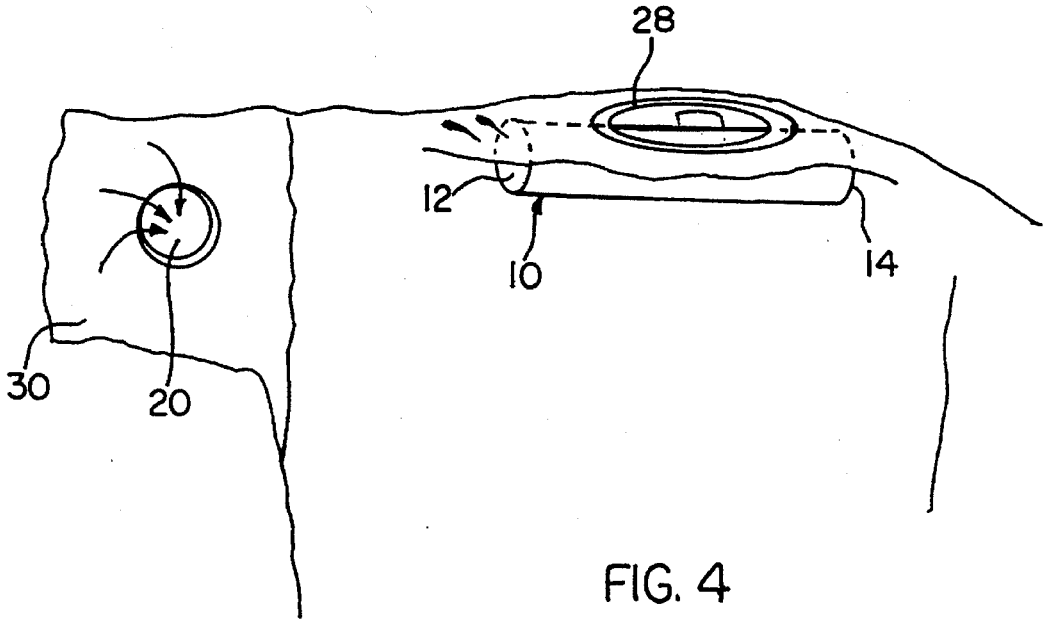
FIG. 4 shows a plan view of a frusto-conical lid-shaped end element in a sleeve of the shirt, and the collar region of the shirt being rolled about the tube-shaped stabilizing element.

As shown in FIGS. 3 and 4, a tube-shaped stabilizing element, for example, a cardboard tube (10), has almost the proportions of a shirt in its final arrangement for presentation, for instance, in the proportions of a beverage can. The middle area (34) of the shirt is rolled onto the tube-shaped stabilizing element along the longitudinal direction of the middle area.

By closing round, lid-shaped stuffing elements (end elements 20, 22) into areas of the shirt, preferably the sleeves (30), and fixing these stuffing elements (20, 22) by means of fixing devices (32), preferably elastic rubber rings, the end elements are formed with hard, round ends laterally aside the ends of the cylindrical middle area (24) after rolling. These stuffing elements (20, 22) have frusto-conical shapes so that they are clamped into the ends (12, 14) of the tube when stuffed into the hollow tube (10).

Figure 2:
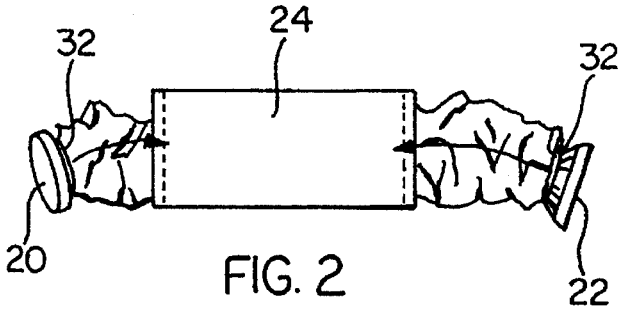
FIG. 2 shows a side view of the lid-shaped end elements before being stuffed into the stabilizing element.

When the remainder of the shirt (36, 38) is stuffed into the hollow tube (10) from the ends (12, 14), the lid-shaped stuffing elements (20, 22) close the arrangement for presentation (16). This is shown in FIG. 2, shortly before the remainder of the shirt (36, 38) is stuffed into the hollow tube (10). The lids can be fixed by means of additional ties or by a tight wrapping. Since the middle area of the shirt (34) is not folded in the typical manner, the middle area of the shirt is unwrinkled.

With such an arrangement for presentation (16), the wrapping protects the shirt against negative environmental influences or damage. The shirts can be stacked on each other (especially on shelves) in several layers, just as cans are stacked, wherein the upper layer fits into the empty spaces of the lower layer. The round end surfaces of the arrangement for presentation (16) provide an indication of the color or design features of an individual shirt.

Figure 1:
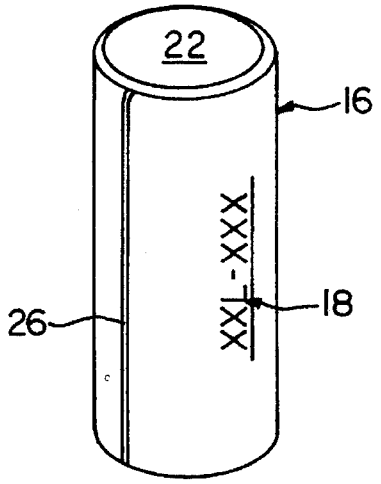
FIG. 1 shows the final cylindrical arrangement of the can-like presentation arrangement according to the present invention.

A paper banderol may be placed around the cylindrical body (24) of the can-shaped packed shirt shown in FIGS. 1 and 2. A design (18) may be printed on the chest area of the shirt after it is folded and rolled around the hollow tube (10) because the horizontal median line (26) will lie on the outside when the shirt is rolled starting with the collar (28).

I claim:

1. A shirt in a can-shaped presentation arrangement, comprising:

a tube-shaped stabilizing element (10) having an outer side and two open ends (12, 14), two lid-shaped end elements (20, 22) fixed on said open ends of said tube-shaped stabilizing element (10), and fixing devices (32) for fixing areas of said shirt around said lid-shaped end elements (20, 22), a middle area of said shirt being rolled onto said outer side of said tube-shaped stabilizing element (10), and additional areas of said shirt extending beyond said open ends of said tube-shaped stabilizing element (10) and being positioned within said tube-shaped stabilizing element (10).

2. The arrangement according to claim 1, wherein said additional areas of said shirt are arranged to be stuffed within said open ends of said tube-shaped stabilizing element (10) before said lid-shaped end elements (20, 22) are fixed on said tube-shaped stabilizing element (10).

3. The arrangement according to claim 2, wherein said lid-shaped end elements (20, 22) comprise stuffing elements clamped in a clamping fashion within said open ends of said tube-shaped stabilizing element (10).

4. The arrangement according to claim 2, wherein said areas of said shirt fixed around said lid-shaped end elements (20, 22) comprise sleeves (30) of said shirt.

5. The arrangement according to claim 2, wherein said shirt is arranged folded approximately in half in its longitudinal dimension along a horizontal median edge arranged on said outer side of said tube-shaped stabilizing element (10), with said shirt enclosing said tube-shaped stabilizing element (10).

6. The arrangement according to claim 2, wherein at least one of said lid-shaped end elements (20, 22) has a frustoconical shape.

7. The arrangement according to claim 3, wherein at least one of said lid-shaped end elements (20, 22) has a frustoconical shape.

* * * * *